US012635810B2

(12) United States Patent
Yang

(10) Patent No.: US 12,635,810 B2
(45) Date of Patent: May 26, 2026

(54) MULTIPURPOSE HIGHCHAIR

(71) Applicant: XIAMEN BABY PRETTY PRODUCTS CO., LTD., Xiamen (CN)

(72) Inventor: Jianbo Yang, Xiamen (CN)

(73) Assignee: XIAMEN BABY PRETTY PRODUCTS CO., LTD., Xiamen (CN)

( * ) Notice: Subject to any disclaimer, the term of this patent is extended or adjusted under 35 U.S.C. 154(b) by 185 days.

(21) Appl. No.: 18/419,566

(22) Filed: Jan. 23, 2024

(65) Prior Publication Data

US 2024/0335051 A1 Oct. 10, 2024

(30) Foreign Application Priority Data

Apr. 7, 2023 (CN) ..... 202320754990.2

(51) Int. Cl.
*A47D 1/00* (2006.01)
*A47D 1/02* (2006.01)

(52) U.S. Cl.
CPC ..... *A47D 1/004* (2013.01); *A47D 1/0081* (2017.05); *A47D 1/0085* (2017.05); *A47D 1/023* (2017.05)

(58) Field of Classification Search
CPC ..... A47D 1/002; A47D 1/004; A47D 1/008; A47D 1/0081; A47D 1/0085; A47D 1/023
See application file for complete search history.

(56) References Cited

U.S. PATENT DOCUMENTS 4,529,245 A * 7/1985 Kassai ..... A47D 1/004 297/30
4,807,928 A * 2/1989 Cone ..... A47C 7/70 297/151
4,958,885 A * 9/1990 Kassai ..... A47D 1/023 297/55
4,968,092 A * 11/1990 Giambrone ..... A47D 1/0085 297/151
5,118,161 A * 6/1992 Slowe ..... A47D 1/0081 297/151

(Continued)

FOREIGN PATENT DOCUMENTS

CN 1615773 A * 5/2005 ..... A47D 1/002
CN 201664113 U * 12/2010 ..... A47D 1/002

(Continued)

*Primary Examiner* — Ryan D Kwiecinski
(74) *Attorney, Agent, or Firm* — Bayramoglu Law Offices LLC

(57) ABSTRACT

A multipurpose highchair is provided. The multipurpose highchair includes two support legs, two armrests, a footrest, a seat plate, a tray, and a backrest, where each of the armrests corresponds to one support leg, and is provided at a top part of the corresponding support leg; the footrest is height-adjustable, and is provided between the two support legs; the seat plate is height-adjustable, and is provided between the two support legs; the tray is adjustable in a front-rear direction, and is provided between the two armrests; and the backrest is provided between rear ends of the two armrests, and is rotatable relative to the two armrests. The tray is adjustable in the front-rear direction relative to the two armrests, the footrest and the seat plate are height-adjustable relative to the two support legs, and the backrest is angle-adjustable to meet different usage needs.

13 Claims, 12 Drawing Sheets

(56) References Cited

U.S. PATENT DOCUMENTS 5,489,138 A * 2/1996 Mariol ..... A47D 1/0085 297/344.14
5,810,432 A * 9/1998 Haut ..... A47D 1/023 297/467
6,089,653 A * 7/2000 Hotaling ..... A47D 1/0085 297/130
6,347,833 B1 * 2/2002 Chen ..... A47D 1/004 297/328
D643,636 S * 8/2011 Hu ..... D6/339
8,100,470 B1 * 1/2012 Hu ..... A47D 1/004 297/148
D839,616 S * 2/2019 Yang ..... D6/339
10,561,254 B2 * 2/2020 Ingraham ..... A47D 1/0083
10,575,656 B2 * 3/2020 Cheng ..... A47D 1/023
D924,576 S * 7/2021 Dorca Pujol ..... D6/339
11,071,396 B2 * 7/2021 Pujol ..... A47D 1/023
D996,838 S * 8/2023 Yang ..... D6/339
11,723,477 B2 * 8/2023 Rogers ..... A47D 1/103 297/118
11,751,699 B2 * 9/2023 Festa ..... A47D 1/02 297/154
11,877,671 B2 * 1/2024 Sclare ..... A47D 1/004
2006/0125293 A1 * 6/2006 Yeh ..... A47D 1/0081 297/16.1
2007/0024095 A1 * 2/2007 Chen ..... A47D 1/004 297/16.1
2007/0290528 A1 * 12/2007 Chen ..... A47D 1/0081 297/41
2008/0217983 A1 * 9/2008 Cheng ..... A47D 1/10 297/445.1
2008/0290699 A1 * 11/2008 Golias ..... A47D 1/004 297/16.1
2009/0146466 A1 * 6/2009 Lan ..... A47D 1/023 297/48
2009/0206639 A1 * 8/2009 Bearup ..... A47D 1/0085 297/151
2009/0250977 A1 * 10/2009 Hu ..... A47D 1/023 297/16.1
2013/0069398 A1 * 3/2013 Chuah ..... A47D 1/0085 297/135
2014/0054938 A1 * 2/2014 Shan ..... A47D 1/10 248/122.1
2016/0007766 A1 * 1/2016 Sack ..... A47D 1/023 297/16.1
2016/0174727 A1 * 6/2016 Haut ..... A47D 1/103 297/130
2018/0192784 A1 * 7/2018 Yang ..... A47D 9/012
2019/0045944 A1 * 2/2019 Yang ..... A47D 7/002
2019/0231087 A1 * 8/2019 Dziak ..... A47D 1/023
2020/0015599 A1 * 1/2020 Mountz ..... A47D 1/006
2020/0128970 A1 * 4/2020 Pujol ..... A47D 1/023
2021/0037989 A1 * 2/2021 Rogers ..... A47D 1/04
2021/0085094 A1 * 3/2021 Rosenthal ..... A47D 1/004
2021/0212478 A1 * 7/2021 Yang ..... A47D 9/012
2021/0401189 A1 * 12/2021 Yang ..... A47D 1/004
2022/0211191 A1 * 7/2022 Bradshaw ..... A47D 1/002
2022/0257022 A1 * 8/2022 Dziak ..... A47D 1/10
2022/0330713 A1 * 10/2022 Yang ..... A47D 9/00
2022/0330714 A1 * 10/2022 Yang ..... A47D 9/02
2022/0386785 A1 * 12/2022 Yang ..... A47D 1/023
2022/0386786 A1 * 12/2022 Yang ..... A47D 1/0083
2023/0117630 A1 * 4/2023 Yang ..... A47D 1/0085 297/127
2023/0200559 A1 * 6/2023 Yang ..... A47D 9/008 5/108
2023/0218121 A1 * 7/2023 Yang ..... A47D 1/008 4/578.1
2023/0346134 A1 * 11/2023 Yang ..... A47D 7/005
2024/0049892 A1 * 2/2024 Yang ..... A47D 1/0081
2024/0285094 A1 * 8/2024 Guo ..... A47D 13/025
2024/0335051 A1 * 10/2024 Yang ..... A47D 1/004
2025/0049228 A1 * 2/2025 Longenecker ..... A47D 1/008
2025/0064226 A1 * 2/2025 Tackaberry ..... A47D 1/0085
2025/0160536 A1 * 5/2025 Longenecker ..... A47D 15/006

FOREIGN PATENT DOCUMENTS

CN 105768695 A * 7/2016 ..... A47D 1/00
CN 107898216 A * 4/2018 ..... A47D 11/02
CN 108552851 A * 9/2018 ..... A47D 1/0085
CN 214855644 U * 11/2021 ..... A47D 1/02
CN 113974373 A * 1/2022 ..... A47D 1/0085
CN 220069303 U * 11/2023 ..... A47D 1/0085
CN 117426644 A * 1/2024 ..... A47D 13/105
DE 10202735 A1 * 8/2003 ..... A47D 1/0085
DE 202013010212 U1 * 2/2015 ..... A47D 1/023
DE 102015106785 A1 * 11/2015 ..... A47D 1/02
EP 2078478 A1 * 7/2009 ..... A47D 13/107
EP 2135528 A1 * 12/2009 ..... A47D 15/006
EP 3449775 A1 * 3/2019 ..... A47D 1/002
EP 4442166 A1 * 10/2024 ..... A47D 1/0085
ES 1077233 U * 6/2012 ..... A47D 1/023
FR 2919164 A1 * 1/2009 ..... A47D 15/006
GB 2404579 A * 2/2005 ..... A47D 1/0081
GB 2428566 A * 2/2007 ..... A47D 1/023
GB 2445185 A * 7/2008 ..... A47D 1/0085
GB 2445280 A * 7/2008 ..... A47D 15/006
GB 2447565 A * 9/2008 ..... A47D 1/006
JP 5832712 B1 * 12/2015 ..... A47C 3/02
JP 3233625 U * 8/2021
WO WO-9716996 A1 * 5/1997 ..... A47D 1/023
WO WO-9916336 A1 * 4/1999 ..... A47D 13/027
WO WO-2006130906 A1 * 12/2006 ..... A47D 1/002
WO WO-2011161392 A1 * 12/2011 ..... A47D 1/023
WO WO-2022093632 A1 * 5/2022 ..... A47D 11/00
WO WO-2024018076 A2 * 1/2024 ..... A47D 13/105
WO WO-2024236070 A1 * 11/2024 ..... A47D 13/107

* cited by examiner

MULTIPURPOSE HIGHCHAIR

CROSS REFERENCE TO THE RELATED APPLICATIONS

This application is based upon and claims priority to Chinese Patent Application No. 202320754990.2, filed on Apr. 7, 2023, the entire contents of which are incorporated herein by reference.

TECHNICAL FIELD

The present disclosure relates to the field of children's products, in particular to a multipurpose highchair.

BACKGROUND

Highchairs are special chairs for feeding children. Highchairs can help children develop the habit of sitting for eating, and can help avoid the trouble of chasing a child for feeding. Children normally sit steadily in a suitable highchair, with their hands free to grasp tableware, thus exercising the coordination of children's hands, eyes and brain. With the development of technology, existing highchairs are foldable to reduce the space they occupy when not in use. However, the folding function of existing highchairs cannot meet all the different usage needs. For example, in existing highchairs, the distance between the tray and the backrest is fixed, which makes it difficult for a child to get in the highchair after the child grows bigger.

SUMMARY

The present disclosure provides a multipurpose highchair, which mainly aims to solve the problem of single function of existing highchairs.

To solve the above technical problem, the present disclosure adopts the following technical solution.

A multipurpose highchair includes two support legs, two armrests, a footrest, a seat plate, a tray, and a backrest, where each of the armrests corresponds to one support leg, and is detachably provided at a top part of the corresponding support leg; the footrest is height-adjustable, and is provided between the two support legs; the seat plate is height-adjustable, and is provided between the two support legs; the tray is adjustable in a front-rear direction, and is provided between the two armrests; and the backrest is provided between rear ends of the two armrests, and is rotatable relative to the two armrests.

Further, the two support legs each include a front support leg and a rear support leg; a top part of the rear support leg is hinged to a middle part of the front support leg; lower parts of the rear support leg and the front support leg are in an inverted "V" shape; and a bottom part of the armrest is inserted into a top part of the corresponding front support leg.

Further, a detachable tray base is provided between the two armrests; the tray base is in a "U" shape in a top view; two ends of the tray base are each provided with a first notch; a left inner side and a right inner side of the tray base are each provided with a first sliding channel and multiple locking ports that are spaced in the front-rear direction; the multiple locking ports are located above the first sliding channel; a bottom part of each of the multiple locking ports is open, and communicated with the first sliding channel; a bottom part of the tray is provided with two guide rods that are arranged at left and right sides; each of the two guide rods corresponds to one first notch, and is located inside the corresponding first notch; one side of the guide rod is provided with a height-adjustable locking element; the locking element is able to be inserted into the locking port; the tray is provided therein with a pull assembly for pulling the locking element up and down; a front end of the pull assembly is provided with a pull plate; the bottom part of the tray is provided with an accommodating plate; a top part of the accommodating plate is provided with a pull plate groove for accommodating the pull plate; a bottom part of the accommodating plate is provided with an accommodating chamber with an open front end and a first movement port communicated with a top part of the accommodating chamber; a bottom part of a front end of the pull plate is provided with a pull part; and the pull part passes through the first movement port, and is located inside the accommodating chamber.

Still further, the pull assembly includes two pull rods, two drive components, two height-adjustable components, and two holding grooves; the pull rods each correspond to one drive component; the drive components each correspond to one height-adjustable component; front ends of the two pull rods are connected to the pull plate; the tray is provided therein with two pull rod grooves, two accommodating grooves, and the two holding grooves; each of the pull rods corresponds to one pull rod groove, and is located inside the pull rod groove; rear ends of the two pull rods are respectively connected to the corresponding drive components; each of the drive components corresponds to one accommodating groove, and is located inside the accommodating groove; each of the height-adjustable components corresponds to one holding groove, and is located inside the holding groove; a bottom part of the drive component is provided with a first inclined surface; a top part of the height-adjustable component is provided with an accommodating slot; a bottom surface of the accommodating slot forms a second inclined surface that is fit with the first inclined surface; half of the drive component is located inside the accommodating slot; the locking element is connected to a bottom part of one side of the height-adjustable component; one side of the guide rod is provided with a second movement port for lifting and lowering the locking element and a slider located in the first sliding channel; one end of the locking element extends out of the second movement port; the slider is provided with a second notch that is communicated with a bottom part of the second movement port and adapted to the locking element; and the accommodating groove is provided therein with two first springs that are abutted against the drive component and an inner wall of the accommodating groove.

Still further, the footrest includes a footrest body and a first support component connected to a bottom part of the footrest body; the seat plate includes a seat plate body and a second support component connected to a bottom part of the seat plate body; the first support component and the second support component are each in an inverted "U" shape; inner sides of the front support legs of the two support legs are respectively provided with second sliding channels; two sides of the first support component are respectively provided with first slide rails; two sides of the second support component are respectively provided with second slide rails; the first slide rails and the second slide rails are located inside the corresponding second sliding channels; the second sliding channels are each provided with multiple first screw holes that are spaced in an up-down direction; top parts of the first slide rails and bottom parts of two ends of the first support component are respectively provided with second screw holes; the first support component is connected to the front support legs through screws that pass through the second screw holes and the first screw holes; top parts of the second slide rails and bottom parts of two ends of the second support component are respectively provided with third screw holes; and the second support component is connected to the front support legs through screws that pass through the third screw holes and the first screw holes.

Yet still further, a rear end of the second support component is provided with multiple support rods that are spaced in a left-right direction; each of the support rods is provided with two fourth screw holes that are arranged in the front-rear direction; the bottom part of the seat plate body is provided with multiple sets of connecting posts; each set of connecting posts includes at least three connecting posts that are spaced in the front-rear direction; a bottom part of each of the connecting posts is provided with a fifth screw hole; a distance between two adjacent fifth screw holes is equal to a distance between the two fourth screw holes; and the seat plate body is connected to the support rod through screws that pass through the fourth screw holes and the fifth screw holes.

Further, inner sides of the rear ends of the two armrests are each provided with a first accommodating hole; an inner circumference of the first accommodating hole is evenly distributed with multiple first engagement teeth; outer sides of two ends of the backrest are each provided with a second accommodating hole; an inner circumference of the second accommodating hole is evenly distributed with multiple second engagement teeth; the second accommodating hole is provided therein with a first hinge shaft; the first accommodating hole and the second accommodating hole are provided therein with a first engagement component; an outer circumference of the first engagement component is provided with multiple first engagement grooves; the multiple first engagement grooves are engaged with the multiple first engagement teeth and the multiple second engagement teeth; the second accommodating hole is provided therein with a second spring that is abutted against the first engagement component; the first hinge shaft passes through the first engagement component and is hinged to the rear end of the armrest; outer sides of the rear ends of the two armrests are each provided with a first button groove; the first button groove is provided therein with a first button; an inner side of the first button is provided with multiple first press parts; the first button groove is provided therein with multiple first through grooves that are configured for the multiple first press parts to pass through and are communicated with the first button groove; and the multiple first press parts pass through the corresponding first through grooves, and are abutted against the first engagement component.

Still further, the middle part of the front support leg is provided with a hinge part; an inner side of the hinge part is provided with a third accommodating hole; an inner circumference of the third accommodating hole is evenly distributed with multiple third engagement teeth; an outer side of the top part of the rear support leg is provided with a fourth accommodating hole; an inner circumference of the fourth accommodating hole is evenly distributed with multiple fourth engagement teeth; the third accommodating hole is provided therein with a second hinge shaft; the third accommodating hole and the fourth accommodating hole are provided therein with a second engagement component; an outer circumference of the second engagement component is provided with multiple second engagement grooves; the multiple second engagement grooves are engaged with the multiple third engagement teeth and the multiple fourth engagement teeth; the third accommodating hole is provided therein with a third spring that is abutted against the second engagement component; the second hinge shaft passes through the second engagement component, and is hinged to the top part of the rear support leg; an outer side of the hinge part is provided with a second button groove; the second button groove is provided therein with a second button; an inner side of the second button is provided with multiple second press parts; the second button groove is provided therein with multiple second through grooves that are configured for the multiple second press parts to pass through and are communicated with the second button groove; and the multiple second press parts pass through the corresponding second through grooves, and are abutted against the second engagement component.

Still further, two outer sides of the tray base are each provided with a clamping part; inner sides of the two armrests are each provided with a clamping groove for inserting the clamping part; and the clamping part is clamped into the clamping groove.

Further, the two support legs each include a front support leg and a rear support leg; a top part of the rear support leg is connected to a middle part of the front support leg; lower parts of the rear support leg and the front support leg are in an inverted "V" shape; and a bottom part of the armrest is inserted into a top part of the corresponding front support leg.

Still further, the multipurpose highchair further includes a lying part and two connecting rods; bottom parts of the two connecting rods are inserted into top parts of the front support legs; and the lying part is rotatably connected between the two connecting rods.

Yet still further, an inner side of the connecting rod is provided with a fifth accommodating hole; an inner circumference of the fifth accommodating hole is evenly distributed with multiple fifth engagement teeth; an outer side of the lying part is provided with a sixth accommodating hole; an inner circumference of the sixth accommodating hole is evenly distributed with multiple sixth engagement teeth; the sixth accommodating hole is provided therein with a third hinge shaft; the fifth accommodating hole and the sixth accommodating hole are provided therein with a third engagement component; an outer circumference of the third engagement component is provided with multiple third engagement grooves; the multiple third engagement grooves are engaged with the multiple fifth engagement teeth and the multiple sixth engagement teeth; the fifth accommodating hole is provided therein with a fourth spring that is abutted against the third engagement component; the third hinge shaft passes through the third engagement component and is hinged to the connecting rod; an outer side of the connecting rod is provided with a third button groove; the third button groove is provided therein with a third button; an inner side of the third button is provided with multiple third press parts; the third button groove is provided with multiple third through grooves that are configured for the multiple third press parts to pass through and are communicated with the third button groove; and the multiple third press parts pass through the corresponding third through grooves, and are abutted against the third engagement component.

According to the description of the present disclosure, compared with the prior art, the present disclosure has the following advantages. The present disclosure has a novel structure and clever design. The tray is adjustable in the front-rear direction relative to the two armrests so as to adjust a distance between the tray and the backrest, facilitating the child in different age groups to get in the highchair.

The footrest and the seat plate are height-adjustable relative to the two support legs, such that parents can adjust the footrest and the seat plate to an appropriate height according to different heights of the child. The backrest is angle-adjustable to meet different usage needs. The present disclosure achieves multiple user-friendly usage functions to suite for many usage needs, and extends the service life of the highchair, rather than limiting the service life of the highchair to a certain period of time during the child growth stage.

DETAILED DESCRIPTION OF THE EMBODIMENTS

Embodiment 1

Figure 1:
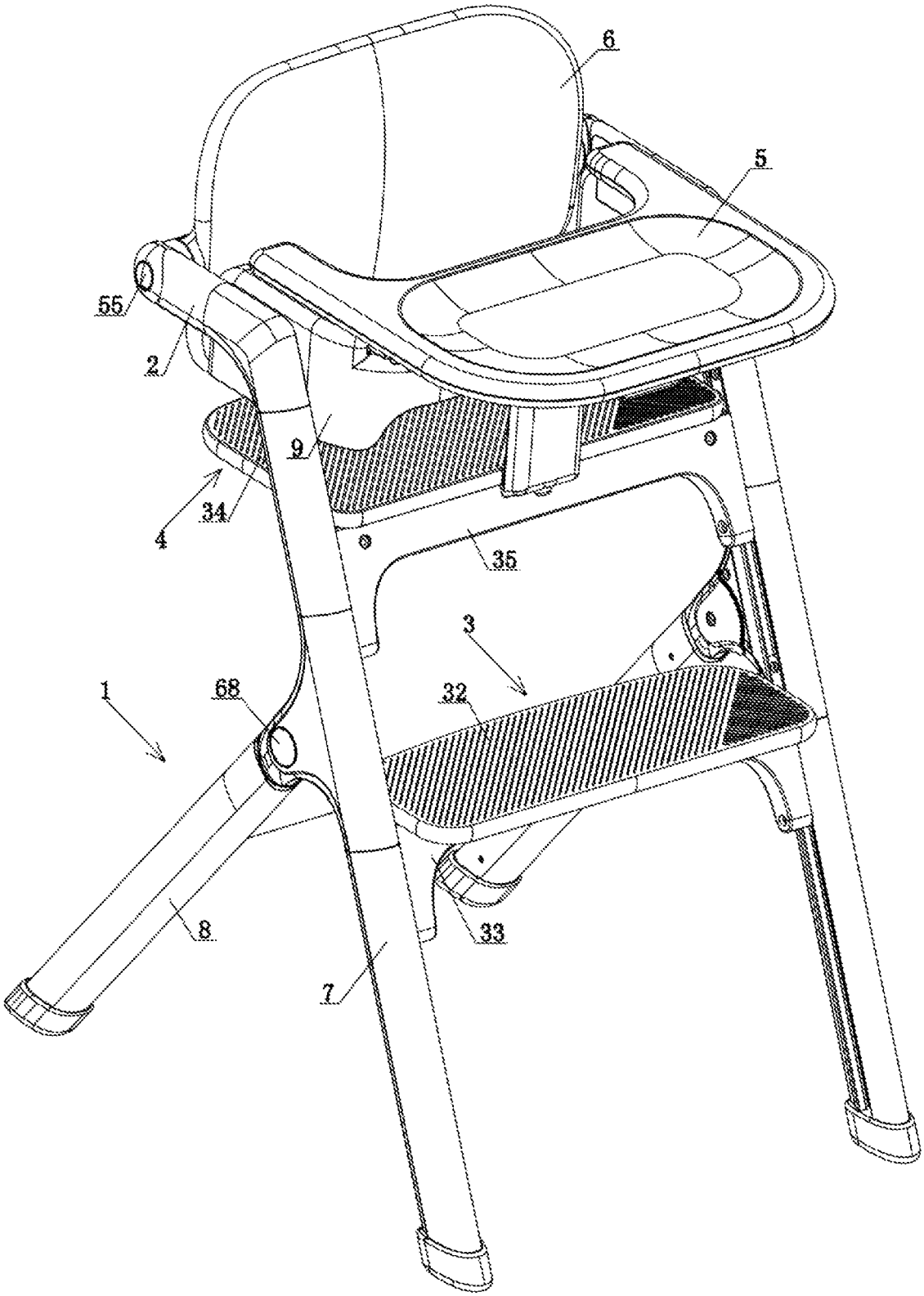
FIG. 1 is a structural diagram of a multipurpose highchair according to Embodiment 1 of the present disclosure.

Referring to FIG. 1, a multipurpose highchair includes two support legs 1, two armrests 2, footrest 3, seat plate 4, tray 5, and backrest 6. The armrests 2 each correspond to one support leg 1. The armrest 2 is detachably provided at a top part of the corresponding support leg 1. The footrest 3 is height-adjustable, and is provided between the two support legs 1. The seat plate 4 is height-adjustable, and is provided between the two support legs 1. The tray 5 is adjustable in a front-rear direction, and is provided between the two armrests 2. The backrest 6 is provided between rear ends of the two armrests 2. The backrest 6 is rotatable relative to the two armrests 2.

Referring to FIG. 1, the two support legs 1 each include front support leg 7 and rear support leg 8. A top part of the rear support leg 8 is hinged to a middle part of the front support leg 7. Lower parts of the rear support leg 8 and the front support leg 7 are in an inverted "V" shape. A bottom part of the armrest 2 is inserted into a top part of the corresponding front support leg 7.

Referring to FIGS. 1 to 5, a detachable tray base 9 is provided between the two armrests 2. The tray base 9 is in a "U" shape in a top view. Two ends of the tray base 9 are each provided with first notch 91. A left inner side and a right inner side of the tray base 9 are each provided with first sliding channel 92 and multiple locking ports 93 that are spaced in the front-rear direction. The multiple locking ports 93 are located above the first sliding channel 92. A bottom part of each of the multiple locking ports 93 is open, and the bottom part of each of the multiple locking ports 93 is communicated with the first sliding channel 92. A bottom part of the tray 5 is provided with two guide rods 10 that are arranged at left and right sides. Each of the two guide rods 10 corresponds to one first notch 91, and is located inside the corresponding first notch 91. One side of the guide rod 10 is provided with height-adjustable locking element 11. The locking element 11 is able to be inserted into the locking port 93. The tray 5 is provided therein with pull assembly 12 for pulling the locking element 11 up and down. A front end of the pull assembly 12 is provided with pull plate 13. The bottom part of the tray 5 is provided with accommodating plate 14. A top part of the accommodating plate 14 is provided with pull plate groove 15 for accommodating the pull plate 13. The pull plate 13 is movable in a front-rear direction in the pull plate groove 15. A bottom part of the accommodating plate 14 is provided with accommodating chamber 16 with an open front end and first movement port 17 communicated with a top part of the accommodating chamber 16. A bottom part of a front end of the pull plate 13 is provided with pull part 18. The pull part 18 passes through the first movement port 17, and is located inside the accommodating chamber 16.

Figure 3:
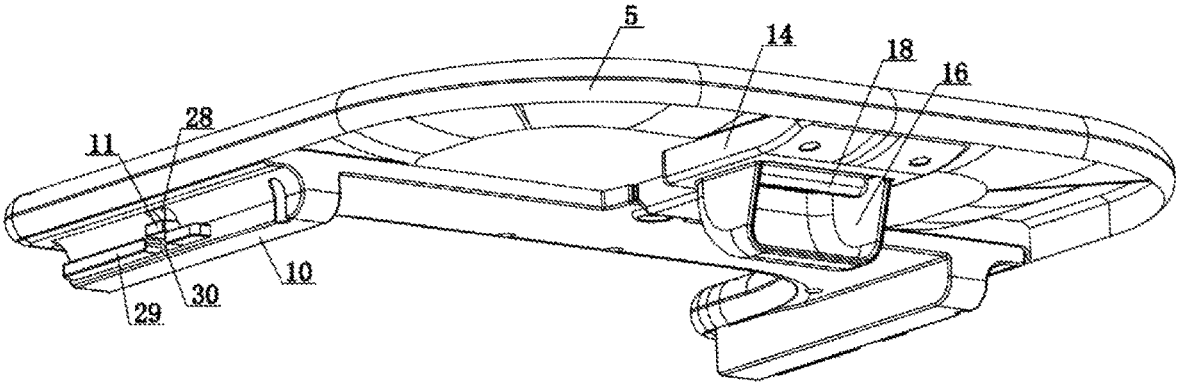
FIG. 3 is a structural diagram of a tray of the multipurpose highchair according to Embodiment 1 of the present disclosure.
Figure 4:
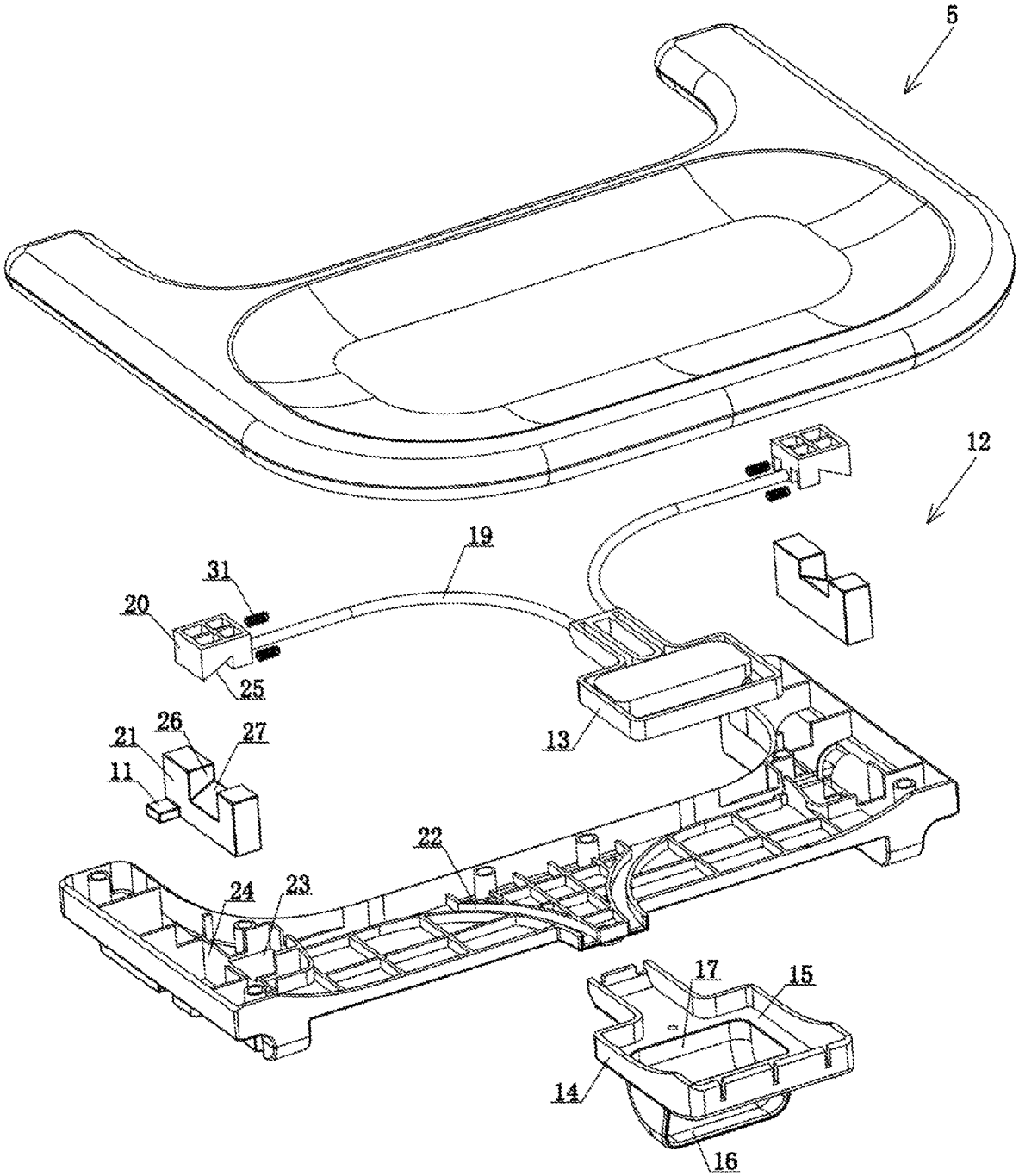
FIG. 4 is an exploded view of the tray of the multipurpose highchair according to Embodiment 1 of the present disclosure.
Figure 5:
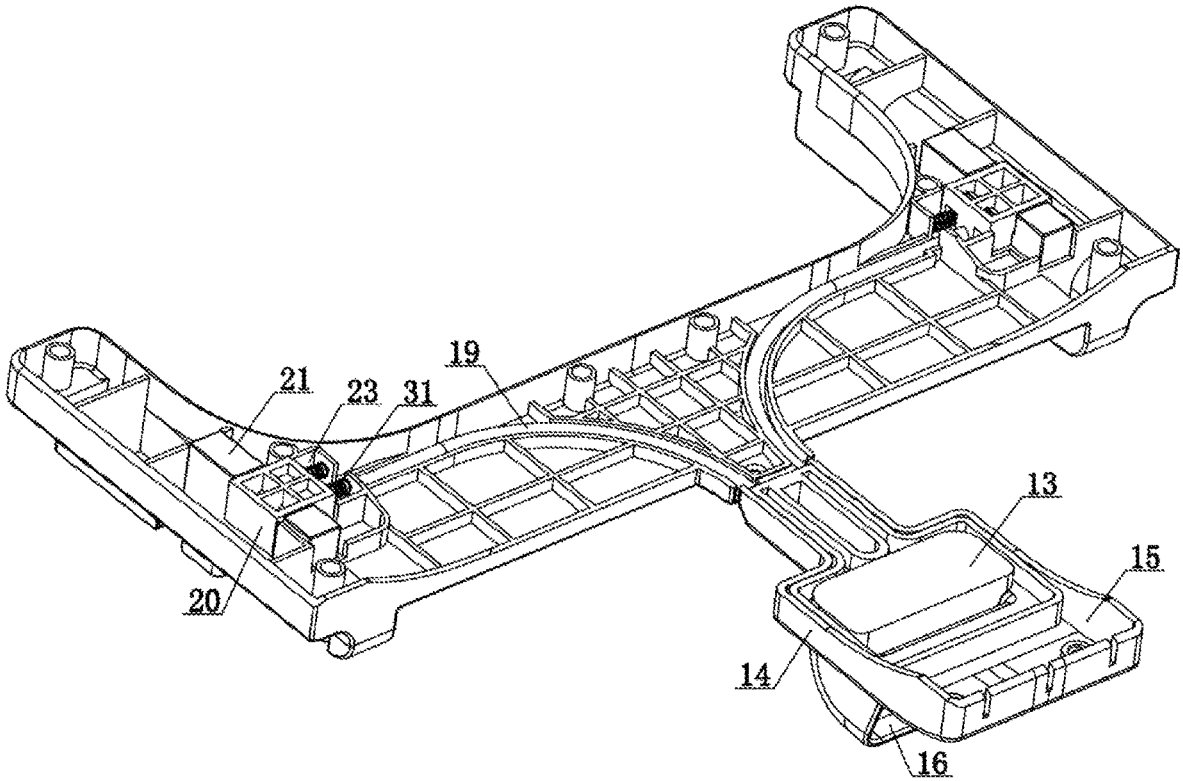
FIG. 5 is an internal structural diagram of the tray of the multipurpose highchair according to Embodiment 1 of the present disclosure.
Figure 6:
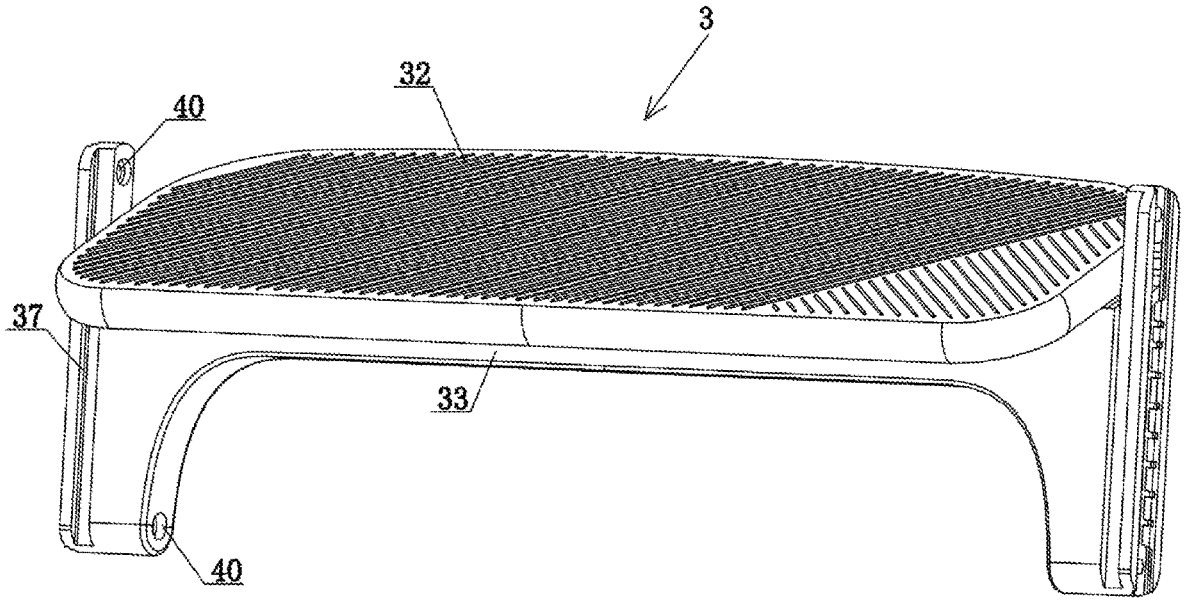
FIG. 6 is a structural diagram of a foot rest of the multipurpose highchair according to Embodiment 1 of the present disclosure.

Referring to FIGS. 3 to 5, the pull assembly 12 includes two pull rods 19, two drive components 20, and two height-adjustable components 21. The pull rods 19 each correspond to one drive component 20. The drive components 20 each correspond to one height-adjustable component 21. Front ends of the two pull rods 19 are connected to the pull plate 13. The tray 5 is provided therein with two pull rod grooves 22, two accommodating grooves 23, and two holding grooves 24. Each of the pull rods 19 corresponds to one pull rod groove 22, and is located inside the pull rod groove 22. Rear ends of the two pull rods 19 are respectively connected to the corresponding drive components 20. Each of the drive components 20 corresponds to one accommodating groove 23, and is located inside the accommodating groove 23. The drive component 20 is movable in a left-right direction in the accommodating groove. Each of the height-adjustable components 21 corresponds to one holding groove 24, and is located inside the holding groove 24. The height-adjustable component 21 is height-adjustable inside the holding groove 24. A bottom part of the drive component 20 is provided with first inclined surface 25. A top part of the height-adjustable component 21 is provided with accommodating slot 26. A bottom surface of the accommodating slot 26 forms second inclined surface 27 that is fit with the first inclined surface 25. Half of the drive component 20 is located inside the accommodating slot 26. The locking element 11 is connected to a bottom part of one side of the height-adjustable component 21. One side of the guide rod 10 is provided with second movement port 28 for lifting and lowering the locking element 11 and slider 29 located in the first sliding channel 92. One end of the locking element 11 extends out of the second movement port 28. The slider 29 is provided with second notch 30 that is communicated with a bottom part of the second movement port 28 and adapted to the locking element 11. The accommodating groove 23 is provided therein with two first springs 31 that are abutted against the drive component 20 and an inner wall of the accommodating groove 23.

Referring to FIGS. 1 to 5, the accommodating chamber 16 is configured for a hand to enter. When the hand pulls the pull plate 13 forward, the two pull rods 19 respectively pull the two drive components 20 to move in opposite directions. The first inclined surface 25 is matched with the second inclined surface 27. When the two drive components 20 are moved close to each other, the two height-adjustable components 21 descend, and the locking element 11 subsequently descends. After the locking element 11 descends, it is separated from the locking port 93 and is located inside the second notch 30. At this point, the tray 5 can be moved in the front-rear direction. When the tray 5 is adjusted to a desired position, the pull plate 13 is released. Under the action of the first springs 31, the two drive components 20 are moved away from each other. The first inclined surface 25 is matched with the second inclined surface 27. In this way, the two height-adjustable components 21 are raised, causing the locking element 11 to be reinserted into another locking port 93.

Referring to FIGS. 1, 6, 7, and 9, the footrest 3 includes foot rest body 32 and first support component 33 connected to a bottom part of the foot rest body 32. The seat plate 4 includes seat plate body 34 and second support component 35 connected to a bottom part of the seat plate body 34. The first support component 33 and the second support component 35 are each in an inverted "U" shape. Inner sides of the front support legs 7 of the two support legs 1 are respectively provided with second sliding channels 36. Two sides of the first support component 33 are respectively provided with first slide rails 37. Two sides of the second support component 35 are respectively provided with second slide rails 38. The first slide rails 37 and the second slide rails 38 are located inside the corresponding second sliding channels 36. The second sliding channels 36 are each provided with multiple first screw holes 39 that are spaced in an up-down direction. Top parts of the first slide rails 37 and bottom parts of two ends of the first support component 33 are respectively provided with second screw holes 40. The first support component 33 is connected to the front support legs 7 through screws that pass through the second screw holes 40 and the first screw holes 39. Top parts of the second slide rails 38 and bottom parts of two ends of the second support component 35 are respectively provided with third screw holes 41. The second support component 35 is connected to the front support legs 7 through screws that pass through the third screw holes 41 and the first screw holes 39. The footrest 3 and the seat plate 4 are height-adjustable. The first support component 33 is connected through a first screw hole 39 at a suitable height, and the second support component 35 is connected through a first screw hole 39 at a suitable height.

Figure 7:
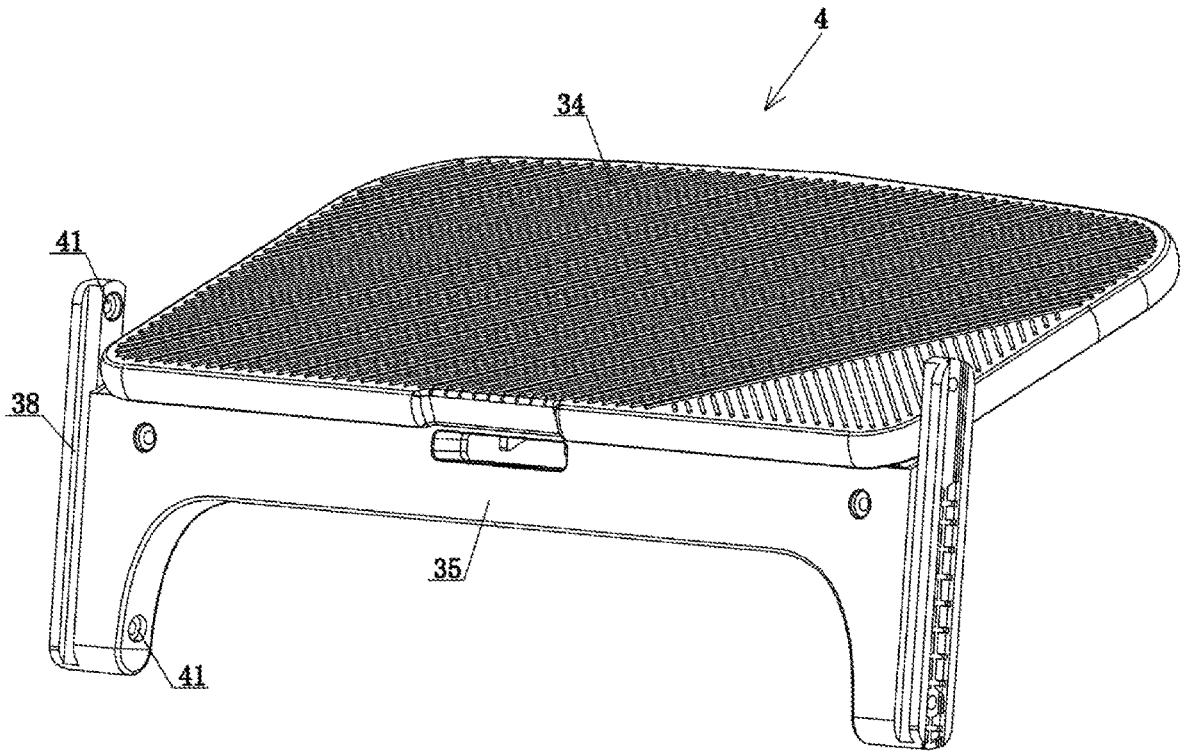
FIG. 7 is a structural diagram of a seat plate of the multipurpose highchair according to Embodiment 1 of the present disclosure.
Figure 8:
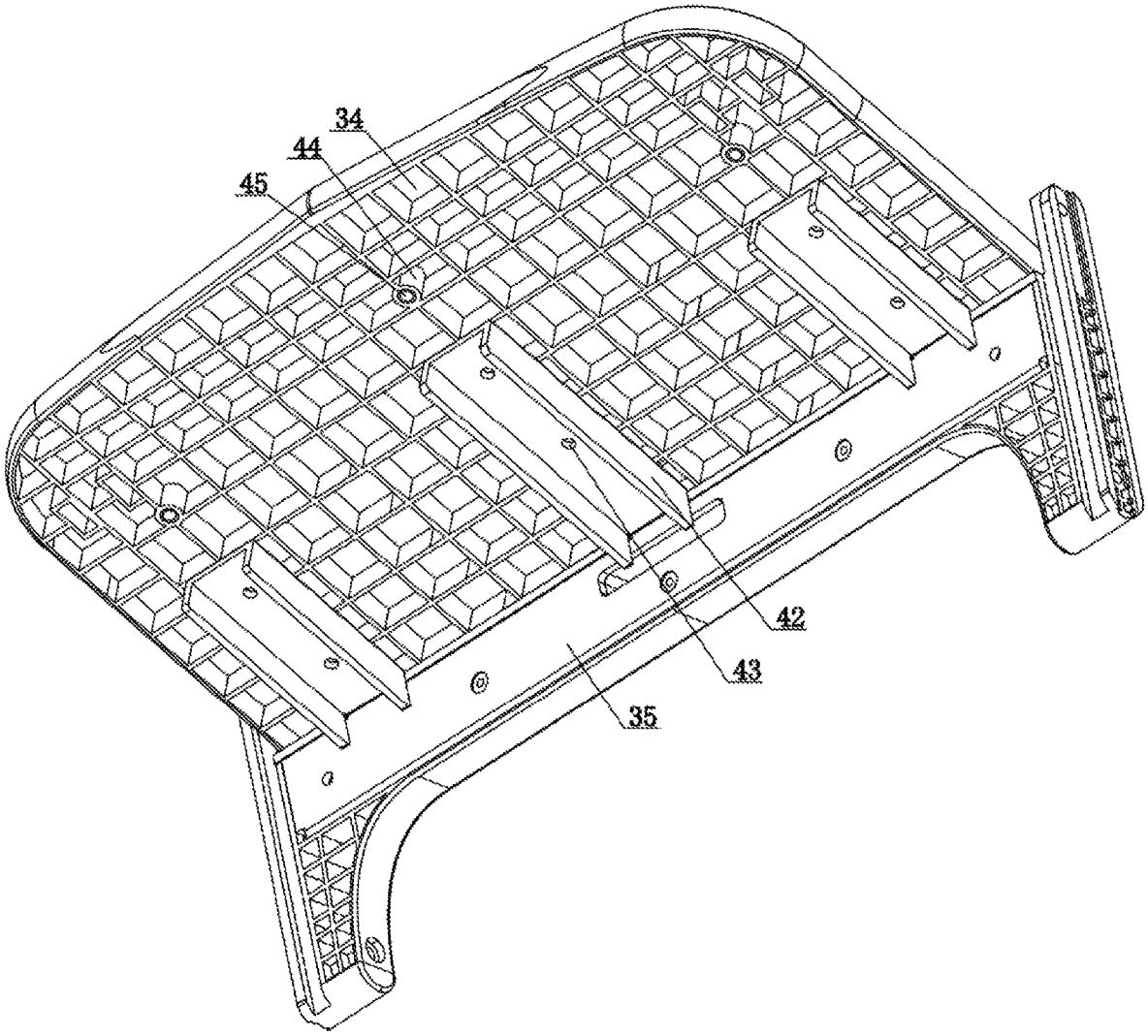
FIG. 8 is a structural diagram of the seat plate of the multipurpose highchair from another angle according to Embodiment 1 of the present disclosure.

Referring to FIGS. 7 and 8, a rear end of the second support component 35 is provided with multiple support rods 42 that are spaced in the left-right direction. Each of the support rods 42 is provided with two fourth screw holes 43 that are arranged in the front-rear direction. The bottom part of the seat plate body 34 is provided with multiple sets of connecting posts 44. Each set of connecting posts 44 includes at least three connecting posts 44 that are spaced in the front-rear direction. A bottom part of each of the connecting posts 44 is provided with fifth screw hole 45. A distance between two adjacent fifth screw holes 45 is equal to a distance between the two fourth screw holes 43. The seat plate body 34 is connected to the support rod 42 through screws that pass through the fourth screw holes 43 and the fifth screw holes 45. Front and rear positions of the seat plate body 34 are adjustable relative to the second support component 35. When the front and rear positions of the seat plate body 34 need to be adjusted, two suitable connecting posts 44 on each support rod 42 are selected to be connected to the two fourth screw holes 43.

Figure 9:
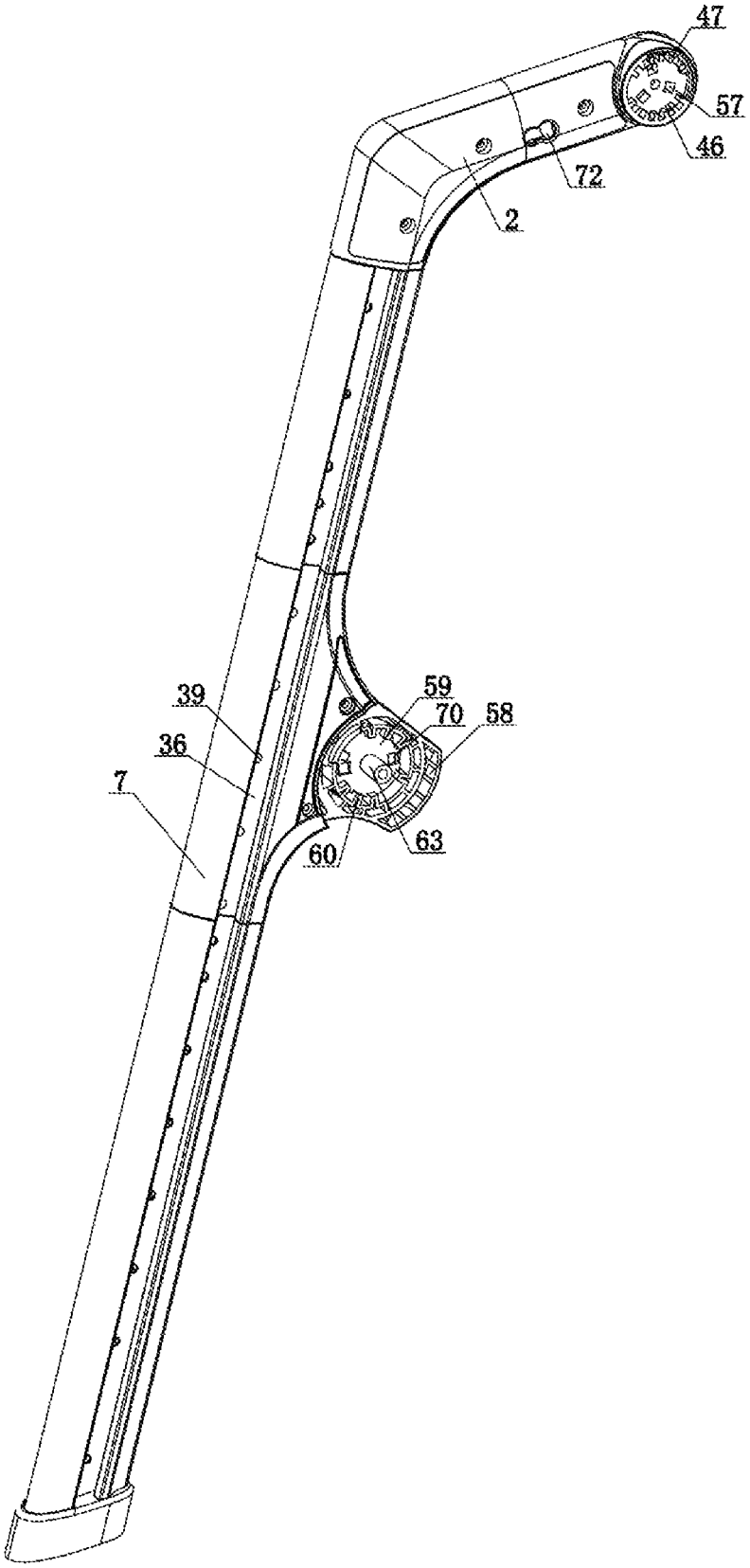
FIG. 9 is a connection diagram of a front support leg and an armrest of the multipurpose highchair according to Embodiment 1 of the present disclosure.
Figure 10:
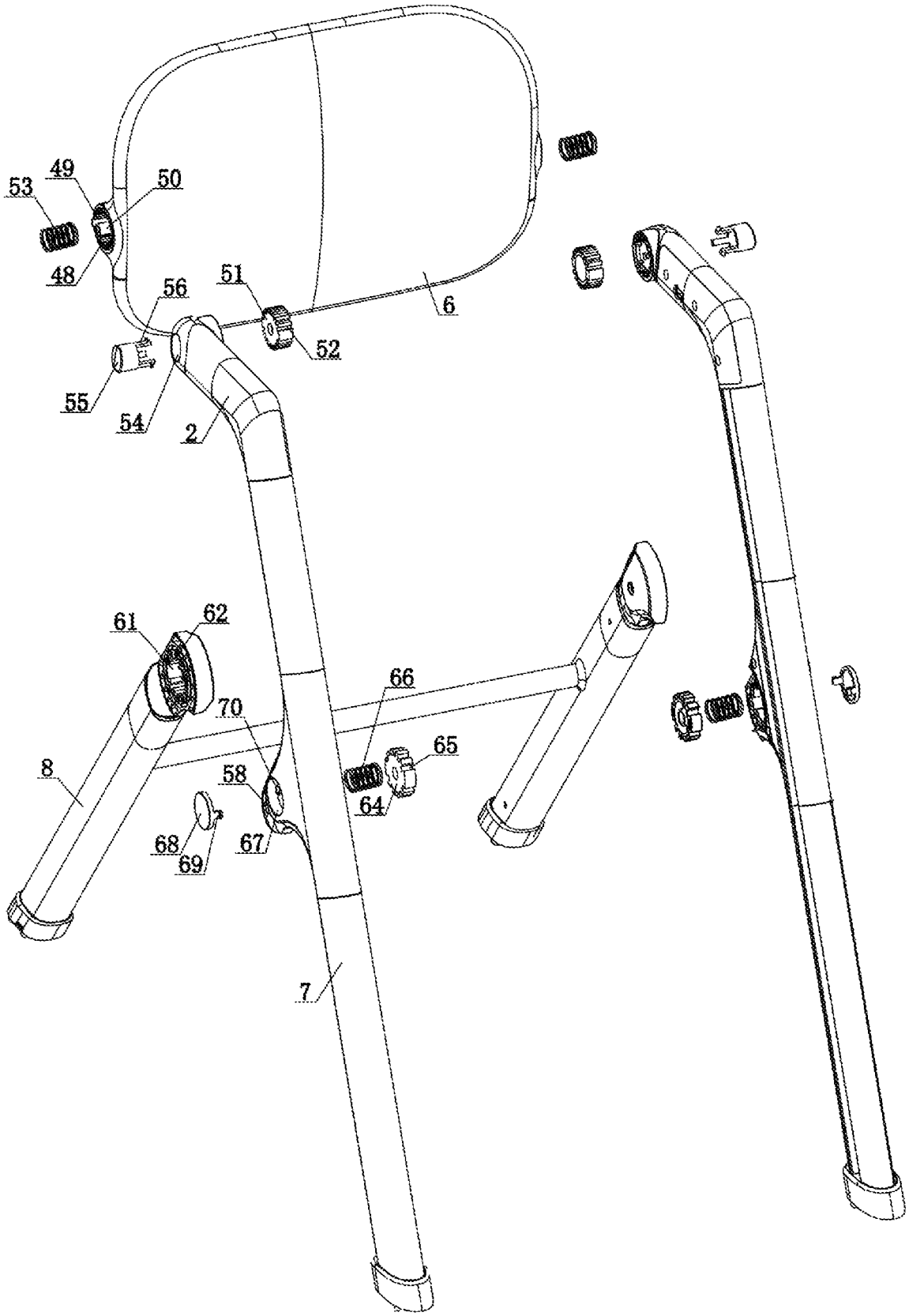
FIG. 10 is an exploded view of a backrest and two support legs of the multipurpose highchair according to Embodiment 1 of the present disclosure.

Referring to FIGS. 9 and 10, inner sides of the rear ends of the two armrests 2 are each provided with first accommodating hole 46. An inner circumference of the first accommodating hole 46 is evenly distributed with multiple first engagement teeth 47. Outer sides of two ends of the backrest 6 are each provided with second accommodating hole 48. An inner circumference of the second accommodating hole 48 is evenly distributed with multiple second engagement teeth 49. The second accommodating hole 48 is provided therein with first hinge shaft 50. The first accommodating hole 46 and the second accommodating hole 48 are provided therein with first engagement component 51. An outer circumference of the first engagement component 51 is provided with multiple first engagement grooves 52. The multiple first engagement grooves 52 are engaged with the multiple first engagement teeth 47 and the multiple second engagement teeth 49. The second accommodating hole 48 is provided therein with second spring 53 that is abutted against the first engagement component 51. The first hinge shaft 50 passes through the first engagement component 51 and is hinged to the rear end of the armrest 2. Outer sides of the rear ends of the two armrests 2 are each provided with first button groove 54. The first button groove 54 is provided therein with first button 55. An inner side of the first button 55 is provided with multiple first press parts 56. The first button groove 54 is provided therein with multiple first through grooves 57 that are configured for the multiple first press parts 56 to pass through and are communicated with the first button groove 54. The multiple first press parts 56 pass through the corresponding first through grooves 57, and are abutted against the first engagement component 51.

Referring to FIGS. 9 and 10, the backrest 6 is rotatable for adjustment relative to the two armrests 2. When in use, the multiple first engagement grooves 52 of the first engagement component 51 are engaged with the multiple first engagement teeth 47 and the multiple second engagement teeth 49. When the backrest 6 needs to be adjusted, the first buttons 55 on the two armrests 2 are pressed. The first engagement component 51 is moved under the drive of the first press parts 56 and separated from the first engagement teeth 47. At this point, the backrest 6 can be rotated for adjustment. When the backrest 6 is adjusted to a desired angle, the first buttons 55 on the two armrests 2 are released. Thus, the first engagement component 51 is reset under the action of the second spring 53, and is reengaged with the multiple first engagement teeth 47 and the multiple second engagement teeth 49.

Referring to FIGS. 9 and 10, the middle part of the front support leg 7 is provided with hinge part 58. An inner side of the hinge part 58 is provided with third accommodating hole 59. An inner circumference of the third accommodating hole 59 is evenly distributed with multiple third engagement teeth 60. An outer side of the top part of the rear support leg 8 is provided with fourth accommodating hole 61. An inner circumference of the fourth accommodating hole 61 is evenly distributed with multiple fourth engagement teeth 62. The third accommodating hole 59 is provided therein with second hinge shaft 63. The third accommodating hole 59 and the fourth accommodating hole 61 are provided therein with second engagement component 64. An outer circumference of the second engagement component 64 is provided with multiple second engagement grooves 65. The multiple second engagement grooves 65 are engaged with the multiple third engagement teeth 60 and the multiple fourth engagement teeth 62. The third accommodating hole 59 is provided therein with third spring 66 that is abutted against the second engagement component 64. The second hinge shaft 63 passes through the second engagement component 64, and is hinged to the top part of the rear support leg 8. An outer side of the hinge part 58 is provided with second button groove 67. The second button groove 67 is provided therein with second button 68. An inner side of the second button 68 is provided with multiple second press parts 69. The second button groove 67 is provided therein with multiple second through grooves 70 that are configured for the multiple second press parts 69 to pass through and are communicated with the second button groove 67. The multiple second press parts 69 pass through the corresponding second through grooves 70, and are abutted against the second engagement component 64.

Referring to FIGS. 9 and 10, the rear support leg 8 is rotatable for folding relative to the front support leg 7. When in use, the multiple second engagement grooves 65 of the second engagement component 64 are engaged with the multiple third engagement teeth 60 and the multiple fourth engagement teeth 62. When the rear support leg 8 needs to be folded, the second button 68 on the front support leg 7 is pressed. The second engagement component 64 is moved under the drive of the second press parts 69 and separated from the fourth engagement teeth 62. At this point, the rear support leg 8 can be rotated for folding. The second button 68 on the front support leg 7 is released. Thus, the second engagement component 64 is reset under the action of the third spring 66, and is reengaged with the multiple third engagement teeth 60 and the multiple fourth engagement teeth 62.

Figure 2:
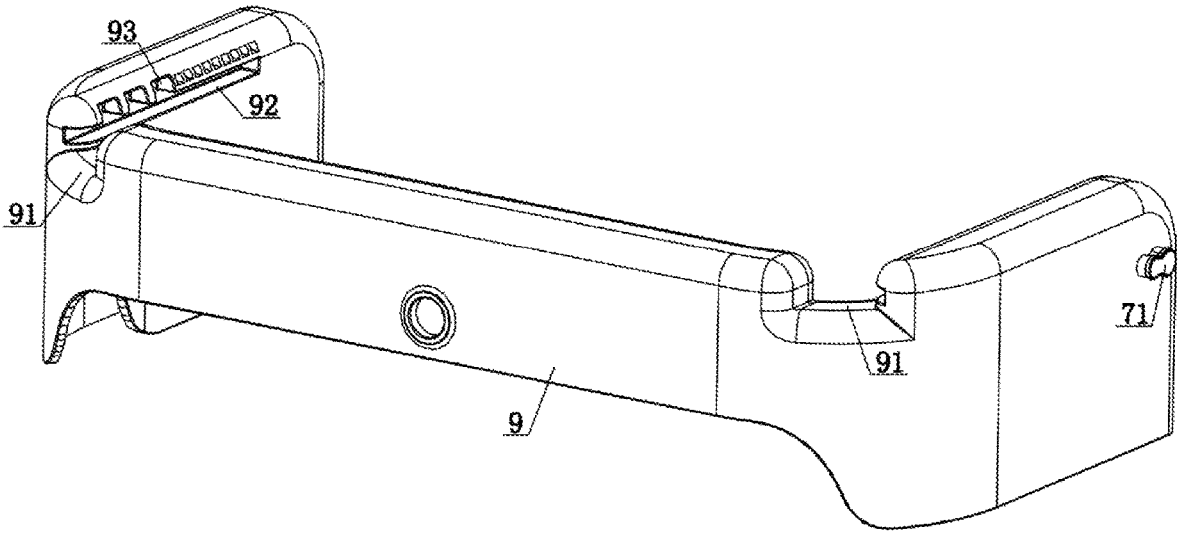
FIG. 2 is a structural diagram of a tray base of the multipurpose highchair according to Embodiment 1 of the present disclosure.

Referring to FIGS. 1, 2, and 9, two outer sides of the tray base 9 are each provided with clamping part 71. Inner sides of the two armrests 2 are each provided with clamping groove 72 for inserting the clamping part 71. The clamping part 71 is clamped into the clamping groove 72. The tray base 9 is connected to the two armrests 2 through the clamping parts 71 that are clamped into the clamping grooves 72. When the tray base 9 is lifted, the clamping parts 71 are separated from the clamping grooves 72. At this point, the tray 5 and the tray base 9 can be removed from the two armrests 2, and the highchair can serve as an adult chair.

Referring to FIG. 1, the tray 5 is adjustable in the front-rear direction relative to the two armrests 2 so as to adjust a distance between the tray 2 and the backrest 6, facilitating the child in different age groups to get in the highchair. The footrest 3 and the seat plate 4 are height-adjustable relative to the two support legs 1, such that parents can adjust the footrest 3 and the seat plate 4 to an appropriate height according to different heights of the child. The backrest 6 is angle-adjustable to meet different usage needs. The front support leg 7 and the rear support leg 8 are foldable to reduce space for stowing. The tray 5 and the tray base 9 can be removed from the armrests 2 to turn the highchair into an adult chair.

Embodiment 2

Figure 11:
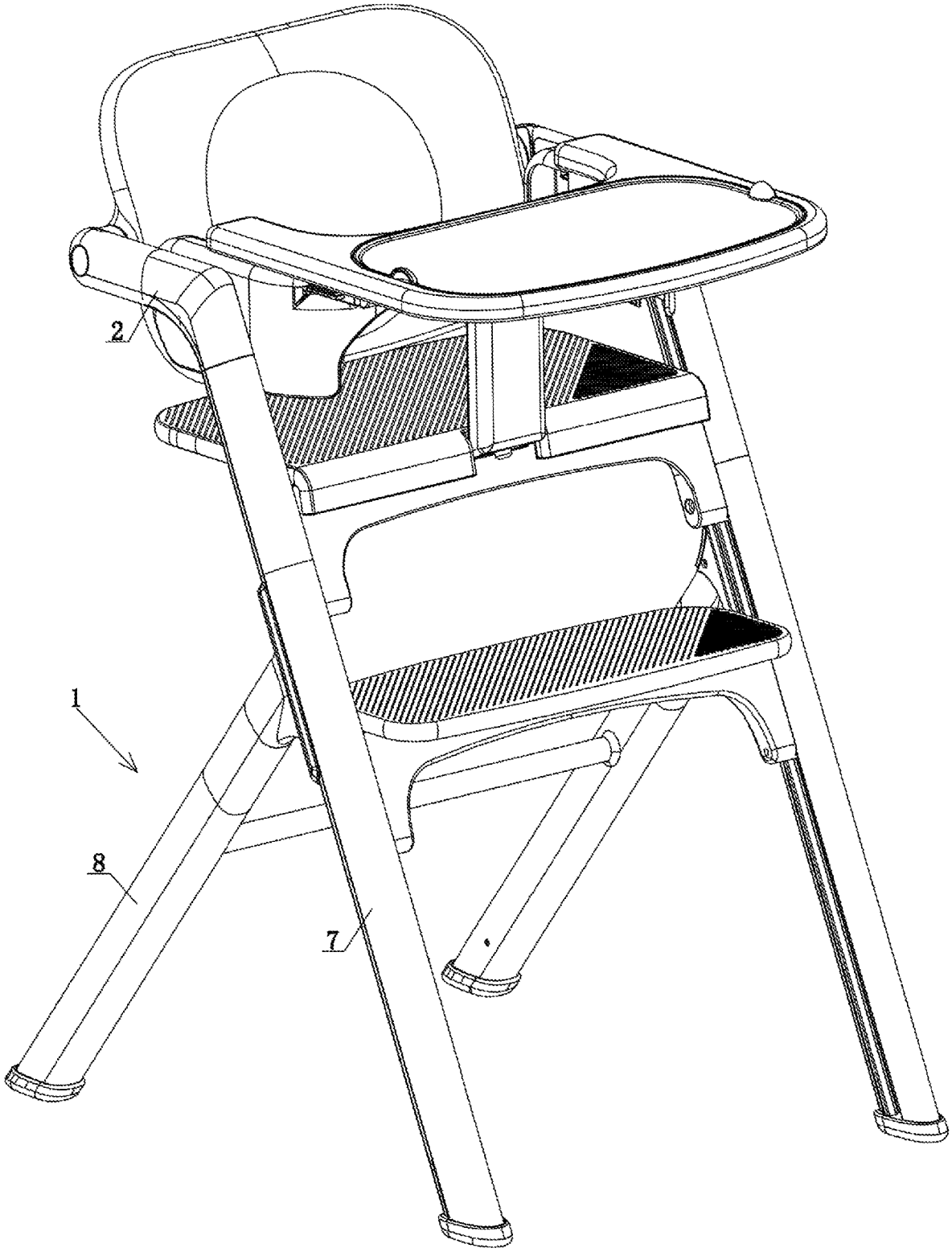
FIG. 11 is a structural diagram of a multipurpose highchair according to Embodiment 2 of the present disclosure.

Referring to FIG. 11, the specific implementation of this embodiment is basically the same as that of Embodiment 1, except the difference below. The two support legs 1 each include front support leg 7 and rear support leg 8. The top part of the rear support leg 8 is connected to the middle part of the front support leg 7. The lower parts of the rear support leg 8 and the front support leg 7 are in an inverted "V" shape. The bottom part of the armrest 2 is inserted into the top part of the corresponding front support leg 7. In this embodiment, the front support leg 7 and the rear support leg 8 are fixedly connected and cannot be folded.

Embodiment 3

Figure 12:
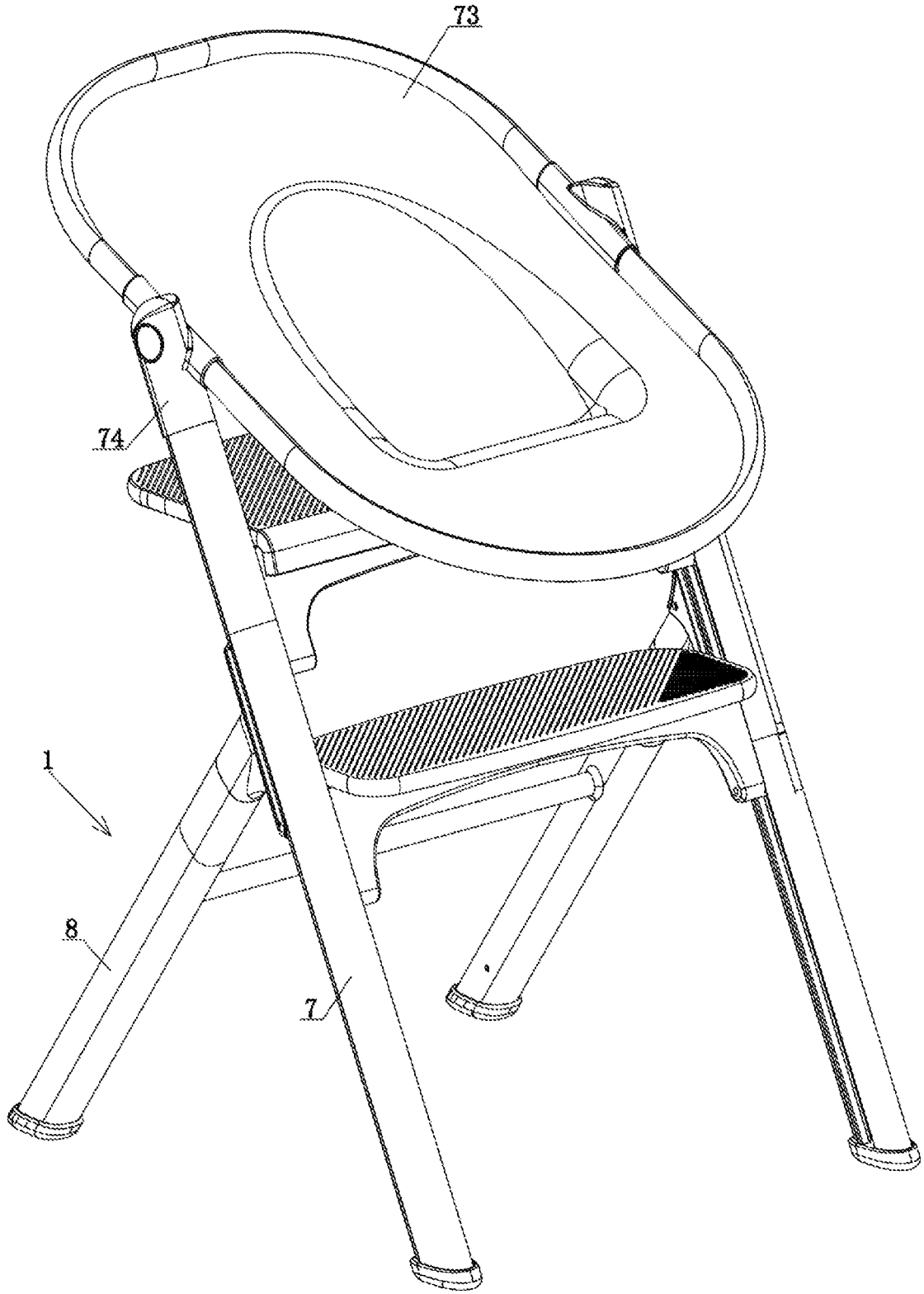
FIG. 12 is a structural diagram of a multipurpose highchair according to Embodiment 3 of the present disclosure.
Figure 13:
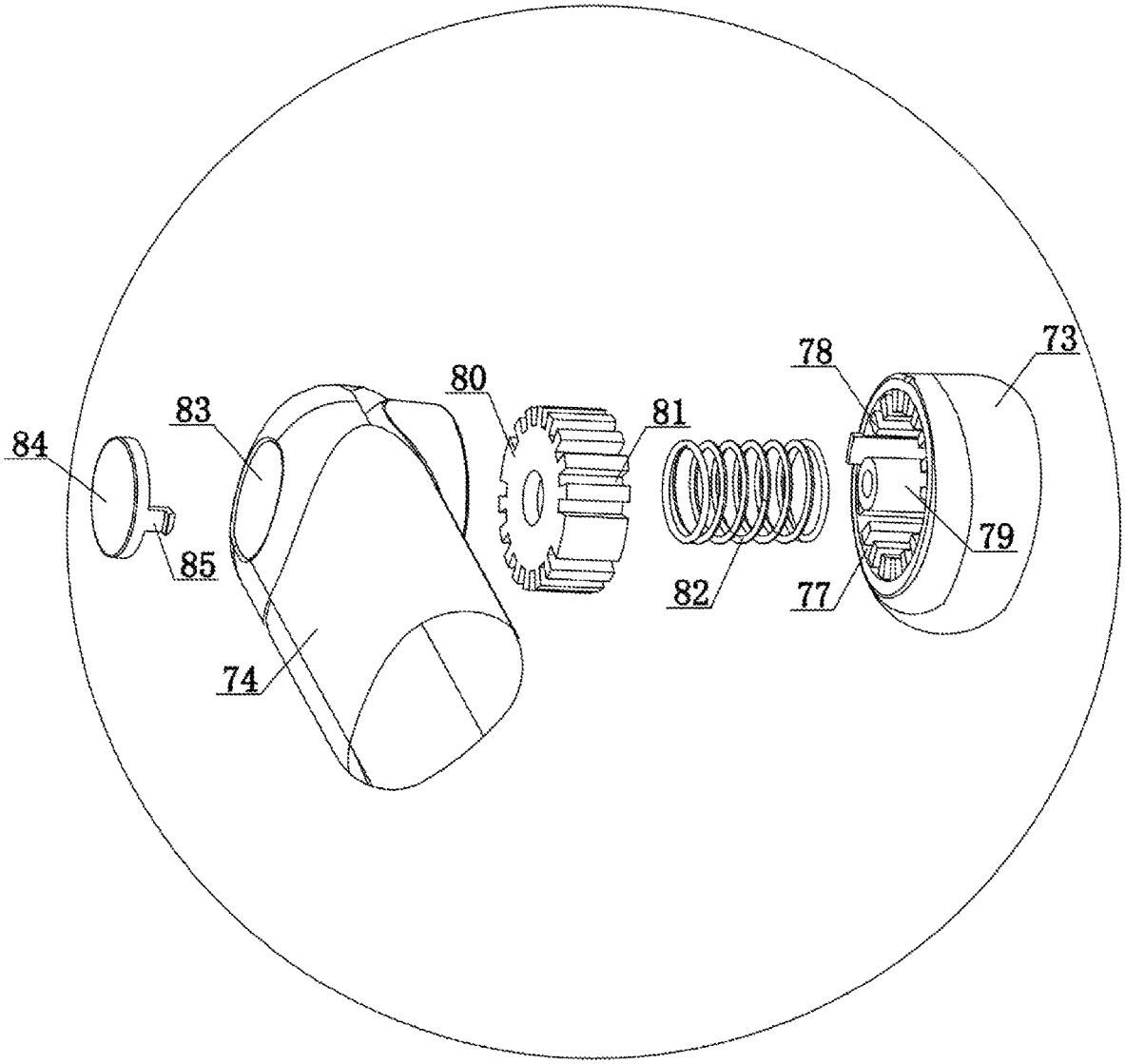
FIG. 13 is a partial exploded view of a connecting rod and a lying part of the multipurpose highchair according to Embodiment 3 of the present disclosure.
Figure 14:
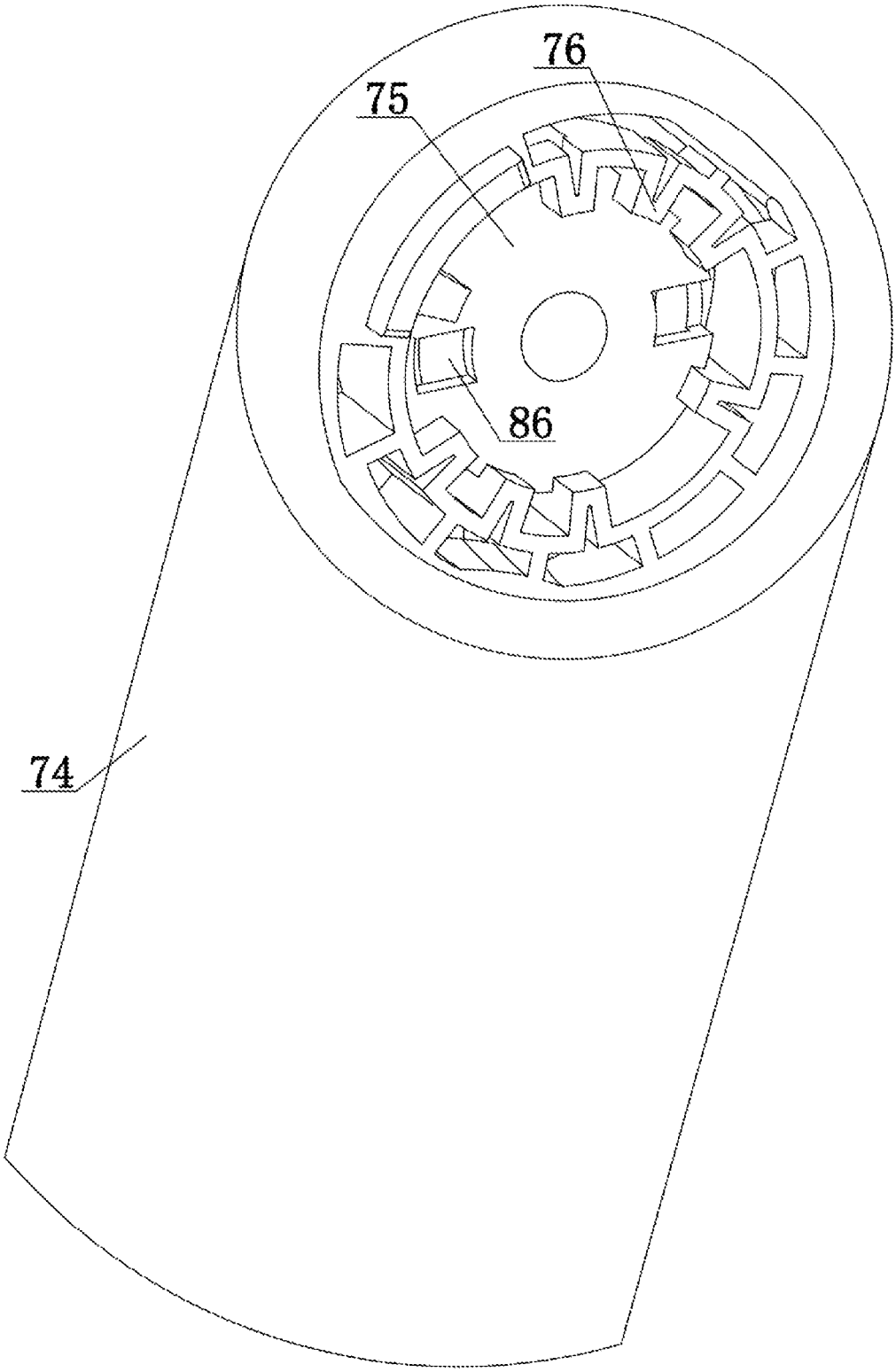
FIG. 14 is a structural diagram of the connecting rod of the multipurpose highchair according to Embodiment 3 of the present disclosure.

Referring to FIGS. 12 to 14, the specific implementation of this embodiment is basically the same as that of Embodiments 1 and 2, except the difference below. The multipurpose highchair further includes lying part 73 and two connecting rods 74. Bottom parts of the two connecting rods 74 are inserted into top parts of the front support legs 7. The lying part 73 is rotatably connected between the two connecting rods 74. An inner side of the connecting rod 74 is provided with fifth accommodating hole 75. An inner circumference of the fifth accommodating hole 75 is evenly distributed with multiple fifth engagement teeth 76. An outer side of the lying part 73 is provided with sixth accommodating hole 77. An inner circumference of the sixth accommodating hole 77 is evenly distributed with multiple sixth engagement teeth 78. The sixth accommodating hole 77 is provided therein with third hinge shaft 79. The fifth accommodating hole 75 and the sixth accommodating hole 77 are provided therein with third engagement component 80. An outer circumference of the third engagement component 80 is provided with multiple third engagement grooves 81. The multiple third engagement grooves 81 are engaged with the multiple fifth engagement teeth 76 and the multiple sixth engagement teeth 78. The fifth accommodating hole 75 is provided therein with fourth spring 82 that is abutted against the third engagement component 80. The third hinge shaft 79 passes through the third engagement component 80 and is hinged to the connecting rod 74. An outer side of the connecting rod 74 is provided with third button groove 83. The third button groove 83 is provided therein with third button 84. An inner side of the third button 84 is provided with multiple third press parts 85. The third button groove 83 is provided with multiple third through grooves 86 that are configured for the multiple third press parts 85 to pass through and are communicated with the third button groove 83. The multiple third press parts 85 pass through the corresponding third through grooves 86, and are abutted against the third engagement component 80.

Referring to FIGS. 11 to 14, in this embodiment, the two armrests 2 can be removed from the corresponding front support legs 7. After the two armrests 2 are removed, the bottom parts of the two connecting rods 74 can be inserted into the top parts of the front support legs 7. At this point, the baby can sit and lie on the lying part 73. When the lying part 73 is in use, the multiple third engagement grooves 81 of the third engagement component 80 are engaged with the multiple fifth engagement teeth 76 and the multiple sixth engagement teeth 78. The lying part 73 is angle-adjustable.

When the lying part 73 needs an angle adjustment, the third buttons 84 on the two connecting rods 74 are pressed. The third engagement component 80 is moved under the drive of the third press parts 85 and separated from the fifth engagement teeth 76. At this point, the lying part 73 can be rotated for the angle adjustment. When the lying part 73 is adjusted to a desired angle, the third buttons 84 are released. Under the action of the fourth spring 82, the multiple third engagement grooves 81 of the third engagement component 80 are reengaged with the multiple fifth engagement teeth 76 and the multiple sixth engagement teeth 78.

The above described are merely specific implementations of the present disclosure, but the design concept of the present disclosure is not limited thereto. Any non-substantial changes made to the present disclosure based on the concept of the present disclosure should fall within the protection scope of the present disclosure.

What is claimed is:

1. A multipurpose highchair, comprising two support legs, two armrests, a footrest, a seat plate, a tray, and a backrest, wherein each of the two armrests corresponds to one support leg, and is detachably provided at a top part of the corresponding support leg; the footrest is height-adjustable, and is provided between the two support legs; the seat plate is height-adjustable, and is provided between the two support legs; the tray is adjustable in a front-rear direction, and is provided between the two armrests; and the backrest is provided between rear ends of the two armrests, and is rotatable relative to the two armrests;

wherein a detachable tray base is provided between the two armrests; the detachable tray base is in a "U" shape in a top view; two ends of the detachable tray base are each provided with a first notch; a left inner side and a right inner side of the detachable tray base are each provided with a first sliding channel and multiple locking ports spaced in the front-rear direction; the multiple locking ports are located above the first sliding channel; a bottom part of each of the multiple locking ports is open, and communicated with the first sliding channel; a bottom part of the tray is provided with two guide rods arranged at left and right sides; each of the two guide rods corresponds to one first notch, and is located inside the corresponding first notch; one side of each of the two guide rods is provided with a height-adjustable locking element; the height-adjustable locking element is configured to be inserted into a locking port of the multiple locking ports; the tray is provided therein with a pull assembly for pulling the height-adjustable locking element up and down; a front end of the pull assembly is provided with a pull plate; the bottom part of the tray is provided with an accommodating plate; a top part of the accommodating plate is provided with a pull plate groove for accommodating the pull plate; a bottom part of the accommodating plate is provided with an accommodating chamber with an open front end and a first movement port communicated with a top part of the accommodating chamber; a bottom part of a front end of the pull plate is provided with a pull part; and the pull part passes through the first movement port, and is located inside the accommodating chamber.

2. The multipurpose highchair according to claim 1, wherein the two support legs each comprise a front support leg and a rear support leg; a top part of the rear support leg is hinged to a middle part of the front support leg; the rear support leg and the front support leg are in an inverted "V" shape; and a bottom part of each of the two armrests is inserted into a top part of the corresponding front support leg.

3. The multipurpose highchair according to claim 2, wherein the footrest comprises a footrest body and a first support component connected to a bottom part of the footrest body; the seat plate comprises a seat plate body and a second support component connected to a bottom part of the seat plate body; the first support component and the second support component are each in an inverted "U" shape; an inner side of the front support leg of each of the two support legs is provided with a second sliding channel; two sides of the first support component are respectively provided with first slide rails; two sides of the second support component are respectively provided with second slide rails; the first slide rails and the second slide rails are located inside the corresponding second sliding channel; the second sliding channel is provided with multiple first screw holes spaced in an up-down direction; top parts of the first slide rails and bottom parts of two ends of the first support component are respectively provided with second screw holes; the first support component is connected to the front support leg through first screws passing through the second screw holes and the first screw holes; top parts of the second slide rails and bottom parts of two ends of the second support component are respectively provided with third screw holes; and the second support component is connected to the front support leg through second screws passing through the third screw holes and the first screw holes.

4. The multipurpose highchair according to claim 3, wherein a rear end of the second support component is provided with multiple support rods spaced in a left-right direction; each of the multiple support rods is provided with two fourth screw holes arranged in the front-rear direction; the bottom part of the seat plate body is provided with multiple sets of connecting posts; each of the multiple sets of connecting posts comprises at least three connecting posts spaced in the front-rear direction; a bottom part of each of the multiple sets of connecting posts is provided with a fifth screw hole; a distance between two adjacent fifth screw holes is equal to a distance between the two fourth screw holes; and the seat plate body is connected to the multiple support rods through the third screws passing through the two fourth screw holes and the fifth screw holes.

5. The multipurpose highchair according to claim 2, wherein the middle part of the front support leg is provided with a hinge part; an inner side of the hinge part is provided with a third accommodating hole; an inner circumference of the third accommodating hole is evenly distributed with multiple third engagement teeth; an outer side of the top part of the rear support leg is provided with a fourth accommodating hole; an inner circumference of the fourth accommodating hole is evenly distributed with multiple fourth engagement teeth; the third accommodating hole is provided therein with a second hinge shaft; the third accommodating hole and the fourth accommodating hole are provided therein with a second engagement component; an outer circumference of the second engagement component is provided with multiple second engagement grooves; the multiple second engagement grooves are engaged with the multiple third engagement teeth and the multiple fourth engagement teeth; the third accommodating hole is provided therein with a third spring abutted against the second engagement component; the second hinge shaft passes through the second engagement component, and is hinged to the top part of the rear support leg; an outer side of the hinge part is provided with a second button groove; the second button groove is provided therein with a second button; an inner side of the second button is provided with multiple second press parts; the second button groove is provided therein with multiple second through grooves configured for the multiple second press parts to pass through and are communicated with the second button groove; and the multiple second press parts pass through the corresponding multiple second through grooves, and are abutted against the second engagement component.

6. The multipurpose highchair according to claim 2, further comprising a lying part and two connecting rods, wherein after the two armrests are removed from the corresponding front support legs, bottom parts of the two connecting rods are inserted into top parts of the front support legs; and the lying part is rotatably connected between the two connecting rods.

7. The multipurpose highchair according to claim 6, wherein an inner side of each of the two connecting rods is provided with a fifth accommodating hole; an inner circumference of the fifth accommodating hole is evenly distributed with multiple fifth engagement teeth; an outer side of the lying part is provided with a sixth accommodating hole; an inner circumference of the sixth accommodating hole is evenly distributed with multiple sixth engagement teeth; the sixth accommodating hole is provided therein with a third hinge shaft; the fifth accommodating hole and the sixth accommodating hole are provided therein with a third engagement component; an outer circumference of the third engagement component is provided with multiple third engagement grooves; the multiple third engagement grooves are engaged with the multiple fifth engagement teeth and the multiple sixth engagement teeth; the fifth accommodating hole is provided therein with a fourth spring abutted against the third engagement component; the third hinge shaft passes through the third engagement component and is hinged to each of the two connecting rods; an outer side of each of the two connecting rods is provided with a third button groove; the third button groove is provided therein with a third button; an inner side of the third button is provided with multiple third press parts; the third button groove is provided with multiple third through grooves configured for the multiple third press parts to pass through and are communicated with the third button groove; and the multiple third press parts pass through the corresponding third through grooves, and are abutted against the third engagement component.

8. The multipurpose highchair according to claim 1, wherein the pull assembly comprises two pull rods, two drive components, two height-adjustable components, and two holding grooves; the two pull rods each correspond to one drive component; the two drive components each correspond to one height-adjustable component; front ends of the two pull rods are connected to the pull plate; the tray is provided therein with two pull rod grooves, two accommodating grooves, and the two holding grooves; each of the two pull rods corresponds to one pull rod groove, and is located inside the corresponding pull rod groove; rear ends of the two pull rods are respectively connected to the corresponding drive components; each of the two drive components corresponds to one accommodating groove, and is located inside the corresponding accommodating groove; each of the two height-adjustable components corresponds to one holding groove, and is located inside the corresponding holding groove; a bottom part of each of the two drive components is provided with a first inclined surface; a top part of each of the two height-adjustable components is provided with an accommodating slot; a bottom surface of the accommodating slot forms a second inclined surface fitting with the first inclined surface; a half of each of the two drive components is located inside the accommodating slot; the height-adjustable locking element is connected to a bottom part of one side of each of the two height-adjustable components; the one side of each of the two guide rods is provided with a second movement port for lifting and lowering the height-adjustable locking element and a slider located in the first sliding channel; one end of the height-adjustable locking element extends out of the second movement port; the slider is provided with a second notch communicated with a bottom part of the second movement port and adapted to the height-adjustable locking element; and each of the two accommodating grooves is provided therein with two first springs abutted against each of the two drive components and an inner wall of each of the two accommodating grooves.

9. The multipurpose highchair according to claim 1, wherein inner sides of the rear ends of the two armrests are each provided with a first accommodating hole; an inner circumference of the first accommodating hole is evenly distributed with multiple first engagement teeth; outer sides of two ends of the backrest are each provided with a second accommodating hole; an inner circumference of the second accommodating hole is evenly distributed with multiple second engagement teeth; the second accommodating hole is provided therein with a first hinge shaft; the first accommodating hole and the second accommodating hole are provided therein with a first engagement component; an outer circumference of the first engagement component is provided with multiple first engagement grooves; the multiple first engagement grooves are engaged with the multiple first engagement teeth and the multiple second engagement teeth; the second accommodating hole is provided therein with a second spring abutted against the first engagement component; the first hinge shaft passes through the first engagement component and is hinged to the rear end of each of the two armrests; outer sides of the rear ends of the two armrests are each provided with a first button groove; the first button groove is provided therein with a first button; an inner side of the first button is provided with multiple first press parts; the first button groove is provided therein with multiple first through grooves configured for the multiple first press parts to pass through and are communicated with the first button groove; and the multiple first press parts pass through the corresponding first through grooves, and are abutted against the first engagement component.

10. The multipurpose highchair according to claim 1, wherein two outer sides of the detachable tray base are each provided with a clamping part; inner sides of the two armrests are each provided with a clamping groove for inserting the clamping part; and the clamping part is clamped into the clamping groove.

11. The multipurpose highchair according to claim 1, wherein the two support legs each comprise a front support leg and a rear support leg; a top part of the rear support leg is connected to a middle part of the front support leg; lower parts of the rear support leg and the front support leg are in an inverted "V" shape; and a bottom part of each of the two armrests is inserted into a top part of the corresponding front support leg.

12. The multipurpose highchair according to claim 11, further comprising a lying part and two connecting rods, wherein after the two armrests are removed from the corresponding front support legs, bottom parts of the two connecting rods are inserted into top parts of the front support legs; and the lying part is rotatably connected between the two connecting rods.

13. The multipurpose highchair according to claim 12, wherein an inner side of each of the two connecting rods is provided with a fifth accommodating hole; an inner circumference of the fifth accommodating hole is evenly distributed with multiple fifth engagement teeth; an outer side of the lying part is provided with a sixth accommodating hole; an inner circumference of the sixth accommodating hole is evenly distributed with multiple sixth engagement teeth; the sixth accommodating hole is provided therein with a third hinge shaft; the fifth accommodating hole and the sixth accommodating hole are provided therein with a third engagement component; an outer circumference of the third engagement component is provided with multiple third engagement grooves; the multiple third engagement grooves are engaged with the multiple fifth engagement teeth and the multiple sixth engagement teeth; the fifth accommodating hole is provided therein with a fourth spring abutted against the third engagement component; the third hinge shaft passes through the third engagement component and is hinged to each of the two connecting rods; an outer side of each of the two connecting rods is provided with a third button groove; the third button groove is provided therein with a third button; an inner side of the third button is provided with multiple third press parts; the third button groove is provided with multiple third through grooves configured for the multiple third press parts to pass through and are communicated with the third button groove; and the multiple third press parts pass through the corresponding third through grooves, and are abutted against the third engagement component.

* * * * *